United States Patent [19]

Mayer

[11] 4,118,157

[45] Oct. 3, 1978

[54] ROTARY COMPRESSOR

[75] Inventor: Endre A. Mayer, Birmingham, Mich.

[73] Assignee: The Bendix Corporation, Southfield, Mich.

[21] Appl. No.: 759,690

[22] Filed: Jan. 17, 1977

Related U.S. Application Data

[63] Continuation of Ser. No. 541,021, Jan. 14, 1975, abandoned.

[51] Int. Cl.[2] ..... F01C 1/02; F01C 21/04; F01C 21/12; F04C 17/02

[52] U.S. Cl. ..... 418/1; 418/54; 418/90; 418/97

[58] Field of Search ..... 418/54, 61 A, 90, 97, 418/99, 1

[56] References Cited

U.S. PATENT DOCUMENTS 1,636,486 7/1927 Planche ..... 418/54

3,191,853 6/1965 Kroeger ..... 418/97

FOREIGN PATENT DOCUMENTS 553,758 1/1922 France ..... 418/54

907,575 7/1945 France ..... 418/54

*Primary Examiner*—John J. Vrablik

*Attorney, Agent, or Firm*—Paul David Schoenle; Ken C. Decker

[57] ABSTRACT

A rotary compressor having a housing with an epitrochoidal inner boundary and a rotor mounted on an eccentric shaft having an inlet port and exhaust port positioned in the working chambers at a neutral pressure zone where the ullage volume expands to a pressure equal to the pressure at the inlet port. The lubricant for the rotor apex seals is supplied under pressure through a restrictor to a lubricating slot positioned transversely in the epitrochoidal inner boundary of the housing adjacent to the inlet aperture at the neutral pressure zone.

10 Claims, 4 Drawing Figures

ROTARY COMPRESSOR

This is a continuation of application Ser. No. 541,021, filed Jan. 14, 1975, now abandoned.

The invention relates to a rotary compressor having a housing with an epitrochoidal inner boundary and a rotor mounted on an eccentric shaft so that the axial center line of the rotor describes a circular path as it rotates in the housing.

PRIOR ART

One of the problems encountered in rotary compressors heretofore was the supply of adequate lubricant to the apex rotor seals to improve compression and avoid excessive wear of the seals. Another problem was the requirement of an inlet check valve which caused restrictions and limitations in the operation of the compressor.

SUMMARY OF THE INVENTION

The present invention avoids the use of an inlet check valve by locating the inlet port in the suction chamber at a neutral pressure zone where the ullage volume expands to a pressure equal to the pressure at the inlet port. The exhaust port also is positioned at a neutral pressure zone diametrically opposite the inlet port across the rotor. These arrangements overcome the restrictions and limitations caused by an inlet check valve and improve compressor efficiency and provide cost reductions and better high speed operation.

In order to provide adequate uniform lubrication to the apex seals on the rotor lubricant is supplied under pressure through a capillary to a slot positioned transversely in the epitrochoidal inner boundary of the housing adjacent the inlet aperture at the neutral pressure zone.

The invention contemplates a rotary compressor having a housing, a rotor rotatably mounted within the housing and providing with said housing a plurality of variable volume working chambers, and an inlet port communicating with said chambers at a neutral pressure zone where the ullage volume expands to a pressure equal to the pressure at the inlet port.

DRAWINGS

FIG. 1 shows a radial section of a rotary compressor constructed according to the invention, FIG. 2 is a transverse view partly in section showing the inlet and outlet ports and lubricating slot in the compressor housing, FIG. 3 is a section taken on the line 3—3 of FIG. 2 in the direction of the arrows showing the lubricating slot, FIG. 4 is a front view showing the exhaust port in the epitrochoidal inner boundary of the housing

DETAILED DESCRIPTION OF THE INVENTION

Figure 1:
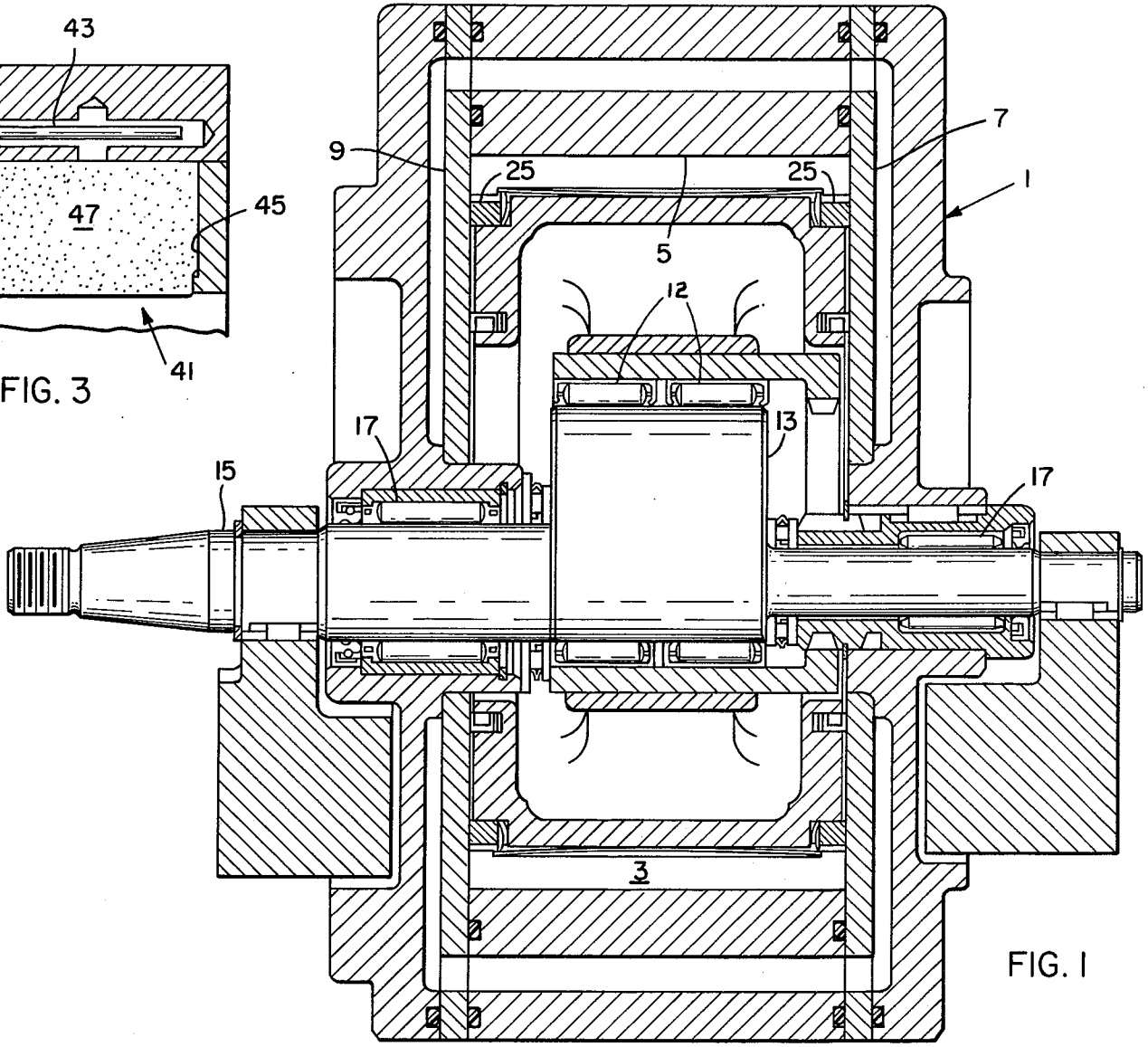
Figure 3:
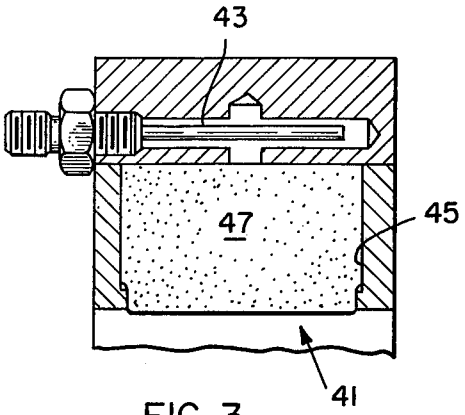

Referring to the drawings, the rotary compressor shown therein and constructed according to the invention has a housing 1 which encloses an internal chamber 3 bounded by a pair of sidewalls 7 and 9 and by a peripheral wall 5 therebetween having an epitrochoidal surface. A generally elliptical rotor 11 with two lobes rotates within chamber 3 on bearings 12 about an eccentric 13 on a shaft 15 rotatably supported by bearings 17 in housing 1.

Rotor 11 has two generally convex portions 19 which face peripheral wall 5 and cooperate therewith to provide two variable volume working chambers. Apex seals 23 at opposite ends of rotor 11 and seals 25 at the corners and sides of the rotor cooperate with peripheral wall 5 and side walls 7 and 9, respectively, for sealing the working chambers.

Figure 2:
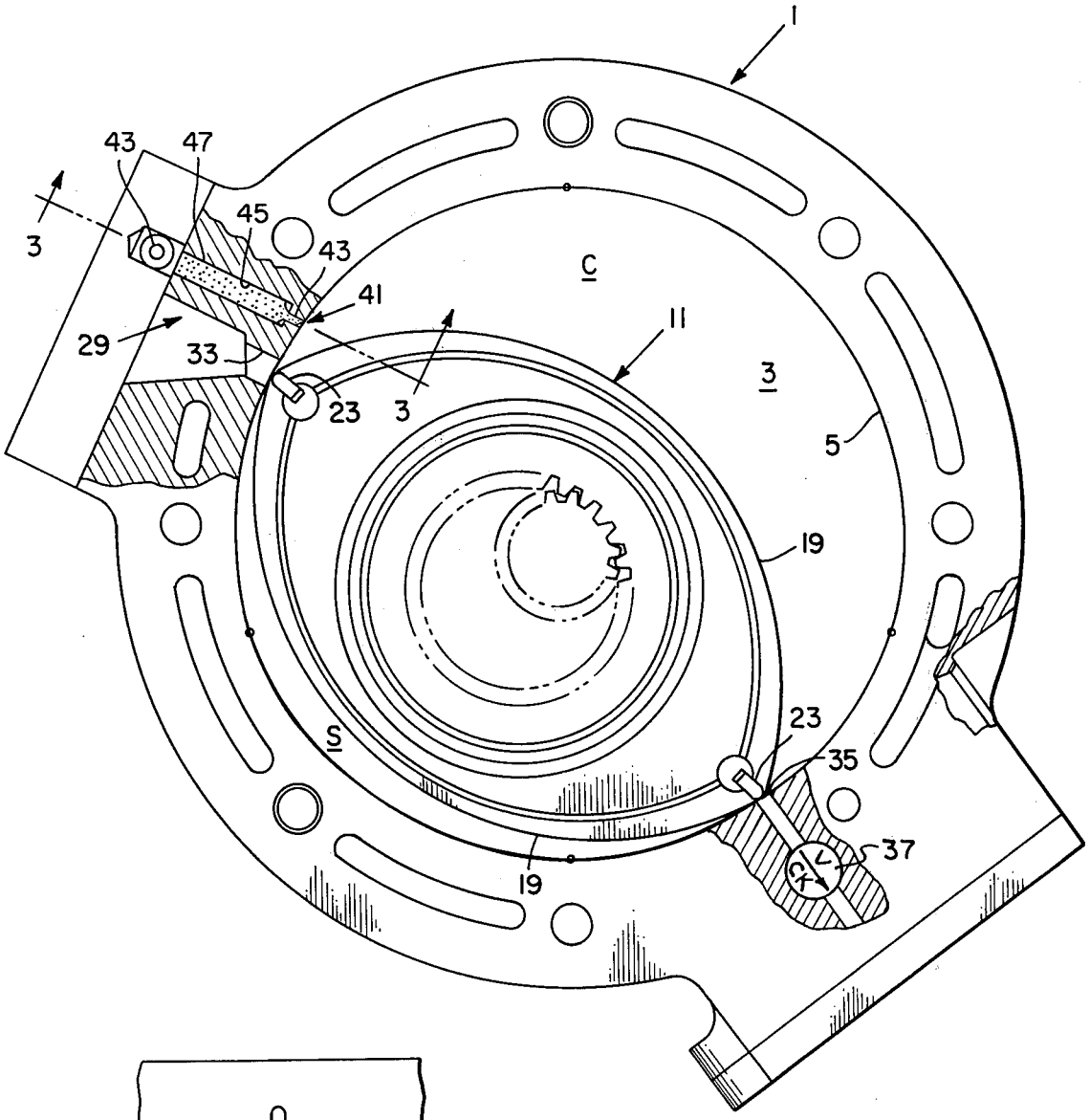
Figure 4:
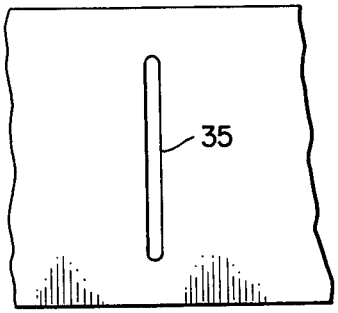

An inlet port 29 and an exhaust port 31 have transverse slots 33 and 35, respectively, in peripheral wall 5 in housing 1 in communication with the working chambers. The inlet and outlet ports 29 and 31 are positioned in neutral pressure zones diametrically opposite one another across rotor 11 at the rotor apexes when the working chambers are at the same pressure as inlet port 29. This occurs just after the rotor passes through top dead center as shown in FIG. 2 when the rotor is at an angle of approximately 100° from center position in which the volumes of the working chambers are equal. With this arrangement the inlet port opens into the suction chambers S when the ullage volume in the suction chamber has expanded to the inlet port pressure. Also, the compression chamber C at this time is at the pressure of the inlet port since the inlet port is closing and the outlet port is opening. As the seals pass the inlet and outlet ports the compression chamber becomes the suction chamber and the suction chamber becomes the compression chamber. In FIG. 2 the chamber S has just completed a compression cycle and is starting a suction cycle. The chamber C has just completed a suction cycle and is beginning a compression cycle. The outlet port is provided with a check valve 37 and a separate unloader valve (not shown) may be used to simplify fabrication of the housing.

As the rotor rotates beyond the zone where the volume in the compression chamber is a minimum, the volume of the chamber increases. The compressed air in the ullage volume expands and drives the rotor for more efficient operation. As the volume increases, the pressure decreases and the outlet check valve closes when the pressure in the chamber is below the pressure at the delivery zone, such as an air tank in a truck brake system.

When the pressure is reduced to the inlet port pressure, the inlet slot is uncovered by the passing apex seal and the outlet port slot is uncovered by the opposing apex seal so that both the inlet and outlet ports open simultaneously when the ullage volume expands to a pressure equal to the pressure at the inlet port. The location of the inlet and outlet ports can be calculated for a known input pressure, which may be atmospheric pressure, and a known delivery pressure, which may be brake air tank pressure.

Lubricant for the apex seal is supplied under pressure through a restrictor, such as a capillary 43, to a felt tipped distribution slot 41 positioned transversely in the peripheral wall of the housing adjacent the inlet slot 33 at the neutral pressure zone. The distribution slot 41 opens into the working chamber and extends into the housing a short distance and opens into a slightly wider slot 45 connected to capillary 43. A supply wick 47 shaped to slots 45 and 41 is positioned therein. Oil flow from the pressure source is metered through the capillary and wick to apex seals 23 at or near inlet port pressure.

Locating the inlet and outlet ports in the working chambers at the neutral pressure zone avoids the use of an inlet check valve and overcomes the restrictions and limitations caused thereby and improves compressor efficiency and provides better high speed operation. Also, supplying lubricant under pressure through a restricted orifice at the neutral pressure zone assures that the lubricant is always injected at or near inlet port pressure. The lubricant is accurately metered and provides adequate uniform lubrication to the apex seals on the rotor.

What is claimed is:

1. A method of compressing fluid using a rotary fluid compressor including a housing having an inlet port, an outlet port including a check valve, a rotor rotatable in a cavity defined within said housing, said rotor having a pair of opposed apexes engaging the wall of said cavity to divide the latter into a pair of chambers, said method comprising the steps of communicating one of the chambers with the inlet port and the other chamber with said outlet port, rotating said rotor to compress the fluid in said other chamber with said check valve open until the rotor attains a minimum volume position in which the volume of said other chamber is minimized, closing said check valve as said rotor rotates past said minimum volume position to trap a volume of fluid in said other chamber, continuing to rotate said rotor past said minimum volume position with said check valve closed to expand the volume of said other chamber to thereby reduce the pressure of the fluid trapped therein until one of the apexes thereof is opposite said outlet port and the other of said apexes is opposite the inlet port, simultaneously communicating said inlet and outlet ports with both of said chambers when the apexes of the rotor are aligned with said ports, and closing communication between the one chamber and the inlet port and between the other chamber and the outlet port as the rotor is rotated past the position in which the apexes are aligned with the ports.

2. A method of compressing fluid using a rotary fluid compressor including a housing having an inlet port, an outlet port including a check valve, rotor rotatable in a cavity defined within said housing, said rotor having a pair of opposed apexes engaging the wall of said cavity to divide the latter into a pair of chambers, said method comprising the steps of communicating one of the chambers with the inlet port and the other chamber with said outlet port, rotating said rotor to compress the fluid in the other chamber with said check valve open until the rotor attains a minimum volume position in which the volume of said other chamber is minimized, closing said check valve as said rotor rotates past said minimum volume position to trap a volume of fluid in said other chamber, continuing to rotate said rotor from said minimum volume position with said check valve closed to expand the volume of said other chamber to thereby reduce the pressure of the fluid trapped therein, and communicating said inlet port with the other chamber and said outlet port to said one chamber when the pressure of the fluid trapped in said other chamber is reduced to the pressure level of the fluid communicating to said inlet port, both of said ports being communicated simultaneously to each of said chambers when said trapped fluid pressure attains the pressure level of the fluid communicated to the inlet port.

3. The invention of claim 2:

wherein the pressure level of said fluid trapped in said other chamber after said check valve is closed is reduced to substantially atmospheric pressure when said trapped fluid pressure attains the pressure level of the fluid communicated to the inlet port.

4. A method of compressing fluid using a rotary fluid compressor including a housing having an inlet port, an outlet port including a check valve, a rotor rotatable in a cavity defined within said housing, said rotor having a pair of opposed apexes engaging the wall of said housing to divide the latter into a pair of chambers, said method comprising the steps of communicating one of the chambers with the inlet port and the other chamber with the outlet port, rotating said rotor to compress the fluid in said other chamber with said check valve open until the rotor attains a minimum volume position in which the volume of said other chamber is minimized, closing said check valve as said rotor rotates past said minimum volume position, to trap a volume of fluid in said other chamber, continuing to rotate said rotor past said minimum volume position with said check valve closed to expand the volume of said other chamber to reduce the pressure of the fluid trapped therein, and simultaneously communicating one of said ports with both of said chambers when the pressure level of the fluid pressure trapped in the other chamber is reduced to a predetermined amount, closing communication between the one chamber and the inlet port and between the other chamber and the outlet port after both of said chambers are simultaneously communicated to the inlet and outlet ports.

5. The invention of claim 4:

wherein the pressure level of said fluid trapped in said other chamber after said check valve is closed is reduced until it is substantially equal to the pressure level at said inlet port.

6. The invention of claim 4:

wherein the pressure level of said fluid trapped in said other chamber after said check valve is closed is reduced to substantially atmospheric pressure when said trapped fluid pressure is reduced to said predetermined amount.

7. A method of compressing fluid using a rotary fluid compressor including a housing having an inlet port, an outlet port including a check valve, a rotor rotatable in a cavity defined within said housing, said rotor having a pair of opposed apexes engaging the wall of said housing to divide the latter into a pair of chambers, said method comprising the steps of communicating one of the chambers with the inlet port and the other chamber with the outlet port, rotating said rotor to compress the fluid in said other chamber with said check valve open until the rotor attains a minimum volume position in which the volume of said other chamber is minimized, closing said check valve as said rotor rotates past said minimum volume position, to trap a volume of fluid in said other chamber, continuing to rotate said rotor past said minimum volume position with said check valve closed to expand the volume of said other chamber to reduce the pressure of the fluid trapped therein, and simultaneously communicating one of said ports with both of said chambers when the pressure level of the fluid pressure trapped in the other chamber is reduced to a predetermined amount, both of said ports being communicated simultaneously to each of said chambers when said trapped fluid pressure is reduced to said predetermined amount.

8. A rotary compressor having a housing having an inlet port and an outlet port, a check valve in said outlet port, a rotor rotatably mounted in said cavity to divide the latter into a pair of chambers, one of said chambers being communicated with the inlet port and the other chamber being communicated with the outlet port, said rotor having a pair of opposed apexes wiping the wall of the housing and controlling communication between the ports and said chambers, said rotor being rotatable with said check valve open until the volume of said other chamber is minimized whereupon said check valve is closed and thereafter being rotatable to expand the volume of said other chamber to expand the fluid trapped therein, said inlet and outlet port being respectively located at opposite apexes of said rotor when the latter is rotated to an expanded volume position in which the volume of said other chamber has increased so that the fluid trapped therein has expanded to a pressure level substantially the same as the pressure level at the inlet port, wherein both of said ports are constructed and arranged so that they simultaneously communicate with both of said chambers when the rotor is disposed in the expanded volume position.

9. The invention of claim 8:

wherein said one of said ports is a slot in the wall of said cavity, said slot being wider than the apexes on the rotor so that said slot communicates with both of said chambers when the rotor is disposed in the expanded volume position.

10. The invention of claim 8:

wherein said housing carries an orifice in the wall of said cavity adjacent said inlet port for supplying lubricant to the apexes of the rotor.

* * * * *